United States Patent [19]

Sotomayer

[11] Patent Number: 5,046,724

[45] Date of Patent: Sep. 10, 1991

[54] PUNCHING DEVICE FOR BOXERS

[76] Inventor: Manuel F. Sotomayer, 1363 W. Placita Bronce, Tucson, Ariz. 85745

[21] Appl. No.: 364,163

[22] Filed: Jun. 12, 1989

[51] Int. Cl.[5] ..... A63B 69/24

[52] U.S. Cl. ..... 272/78

[58] Field of Search ..... 272/72, 76, 77, 78

[56] References Cited

U.S. PATENT DOCUMENTS

| | | | |
|---|---|---|---|
| 519,918 | 5/1894 | MacLearn | 272/78 |
| 581,462 | 4/1897 | Hess | 272/78 |
| 1,044,987 | 11/1912 | Campbell . | |
| 1,733,709 | 10/1929 | Zinnow | 272/78 |
| 2,009,040 | 11/1934 | Beach | 272/78 |
| 3,022,072 | 2/1962 | Zinnow | 272/78 |
| 3,427,021 | 2/1969 | Donato . | |
| 4,662,630 | 5/1987 | Dignard | 272/76 |
| 4,749,185 | 6/1988 | Spears . | |

FOREIGN PATENT DOCUMENTS

| | | | |
|---|---|---|---|
| 0787434 | 9/1935 | France | 272/78 |

*Primary Examiner*—Richard J. Apley

*Assistant Examiner*—L. Thomas

*Attorney, Agent, or Firm*—J. Michael McClanahan

[57] ABSTRACT

A punching device for boxers to be used simultaneously by spaced apart facing boxers, the punching device connected to the floor with an extension coil spring attached to an upper post, the upper post then having oppositely situated outwardly extending punching or boxing bags, the punching bags attached to the upright upper post by separate extension coil springs. One boxer will hit one boxing bag causing it to retreat from his blow while simultaneously imparting motion into the opposite boxing bag, the resultant movement of the opposite boxing bag effected by the response of 3 extension coil springs. Such presents a boxing bag moving in an unpredictable path for the opposite boxer, who, in turn punches his bag which then effects the first boxers boxing bag. Such device provides unexpected response to another fighter's punches simulating movements of opponent boxers in a boxing or sparing match. In addition, the invention may be utilized by a single boxer, in which case, it responds similarly to presently commonly available punching bags.

15 Claims, 1 Drawing Sheet

PUNCHING DEVICE FOR BOXERS

BACKGROUND OF THE INVENTION

1. FIELD OF THE INVENTION.

The field of the invention is devices providing a punching bag to respond to a boxer's punch.

2. DESCRIPTION OF THE RELATED ART.

In the field of the invention, most all people are familiar with the two basic or common types of punching bags, the first which is tear drop shaped and which is attached at the center of a rather large flat overhead disk at a point where the enlarged bulbous portion of the punching bag is situated at proximately the boxer's head height. The tear drop punching bag, generally an air bladder covered by leather or plastic, is struck by the boxer. The bag responds by bouncing back against the flat disk and then returns to its normal vertical position. Practiced boxers will form a rhythm hitting the bag since its expected place of return is essentially known. This punching bag, which is known as a "speed bag", however does not simulate the actions and reactions of an opponent.

The second type of punching bag commonly seen in gyms and well known is the rather large bag, resembling a duffle bag, being cylindrical in shape, padded, heavy and suspended from the ceiling. These bags, which respond to a boxer's punches, swing from the chain or other means suspending them and, because of their weight, have rather a large amount of inertia. However, these bags also suffer from the shortcoming that the boxer always knows where the bag is going to be, therefore he directs his next punch without really being concerned, since he knows the bag is going to be there to receive the punch.

Other types of punching bag devices are less Hess and Zinnow, U.S. Pat. Nos. 581,462 and well known, such as the devices shown in the patents to 3,022,072 respectively. Both of these patents present a punching device consisting of a bag at the end of a vertical pole wherein by the construction of the pole, springing action is provided to bring the punching bag back to its original at rest position after being struck by a boxer, although there will be considerable overshoot, perhaps 4 or 5 times before the bag rests. This is accomplished in Hess by a single upright steel rod and by Zinnow utilizing an elongated upright spring.

Another punching device known to the inventor is that shown in the patent to Donato, U.S. Pat. No. 3,427,021 wherein a striking surface is operably mounted to a wall, the striking surface having a compression type spring interposed it and the wall. The spring operates within telescoping cylindrical sections such as to linearly confine the travel of the striking surface. Upon being struck, the striking surface retreats toward the wall and &hen when all the energy of the punch has been absorbed by the spring, the spring then returns the striking surface to its original position.

While the devices known to the inventor do provide surfaces to be struck and certainly do exercise the muscles of the boxer, yet the response of the surface struck or the punching bag to a boxer's punch is always known or easily and readily ascertainable. However, the punching bags or striking devices do not give the boxer practice closely related to an actual match with an opponent since in a match, you can not always determine well in advance the opponent's movements as you can with known punching bags and striking devices.

In addition, since it is well known that sparing practice between boxers has been known to cause injuries, it would be useful to provide a punching device which simulates sparing practices, but without the potential for injuries.

It is apparent that it would be useful to provide a punching device which would be useful to a boxer which more closely resembles the moving target of an opponent in an actual match. Such would be accomplished by a device having a striking surface which, when responding to a punch after being deflected, is influenced by unknown forces or forces outside the of the ability of the boxer to ascertain. Such is the function of the present invention.

Accordingly, there is an advantage of providing a punching device for boxers which provides a punching bag or striking surface for a boxer wherein a punching bag is available for being hit, and may be utilized by a single boxer and which returns to its original position substantially in a known manner, Yet, if in addition, such a device has a second boxer operating on it simultaneously providing influence to the punching bag's movement and positional situation, although the two boxers never touch each other, and by the addition of such second boxer, movement of the striking surface to its original position after being struck may not be easily ascertained by the first boxer, a more realistic punching device is provided for the boxer.

In addition, if each boxer is interchangeable, it is apparent that great benefit is provided for training of two boxers simultaneously with a single punching device.

SUMMARY OF THE INVENTION

This invention relates to a novel punching device for boxers adapted to provide a pair of oppositely situated punching bags, the punching bags operably connected with each other such that the receipt of a punch by one punching bag has an effect upon the other punching bag, and in addition, the means suspending the bags also respond to the strike of one punching bag to effect movement and position of the second bag.

More specifically, the invention has a base fixedly mounted to the floor, which base continues to a short vertically situated lower post. To this lower post is attached one end of an extension spring, i.e., that type which has adjacent coils touching and adapted to return to its rest position after one or the other end of the spring has received some perturbation, usually not however by stretching the spring along its cylindrical axis, but by securing one end and deflecting the other. The second end of the spring is attached to an upper post, holding the post upright. Attached to the upper post at the height of a boxer's upper chest or lower neck area, although this height may be adjusted, are a pair of oppositely situated punching bags. Each punching bag is connected to the upper post by means of additional extension springs, these extension springs attached at one end to a flat bracket, the bracket in turn attached to the upper post. To the other end of each extension spring is attached a sphere, the sphere covered with padding and then a protective covering. These spheres, together with their protective covering, comprise the punching bags receiving strikes from the boxers. The brackets which connects to the spring and then to the punching bags are situated on opposite sides of the upper post by means of wing bolts which thread into openings formed into the post. By means of variously spaced threaded openings, the height of each punching bag may be adjusted to accommodate boxers of different statures.

All springs utilized in the device are extension type springs and, for protection of the boxers, all are covered with rubber boots.

In the use of the inventive punching device for boxers, preferably two boxers operate the device simultaneously. They are situated opposite each other, but not touching or able to touch, but each within striking range of a punching bag. One boxer strikes the punching tag which he faces and this causes a deflection of this bag. If the boxer hits the bag straight on, the force of the punch is transmitted axially through its compression spring to the upper vertical post which causes the whole device to bend away from the first boxer at the extension spring connecting the upper and lower posts. The upper post responds to the punch by bending backwards through the action of its extension spring. Since the second punching bag is also connected to the upright post and opposite the first punching bag, the second boxer will see the second punching bag coming at him and he will respond by hitting it. If the second boxer hits his bag straight on, this causes the punching device to react as explained above, thus presenting to the first boxer the punching bag coming back to him, and additionally, coming back at him before it would normally respond if the second boxer were not also operating on the second punching bag. Thus, the first boxer cannot necessarily always predict when his punching bag is going to be returning to its normal resting position.

In addition, the position of the punching bag at any one time becomes even more complicated as the boxers strike the punching bag in directions other than along the cylindrical axis of the extension springs attached to each punching bag. When the punching bag is struck from the side, which will happen more often than straight on, the punching bag extension springs are put to work and perturbated so that at least two extension springs can be sure of working and responding to a boxer's strike, i.e., the extension spring connected to the punching bag just struck, and the extension spring connected to the upper post and the lower post and base. Then, since the second boxer cannot anticipate the position of the second punching bag early on, he must meet it with his strikes after movement has been initiated, but only upon split second judgment on his part. Of course, the second punching bag will have inertia of its own which will also effect its position vis-a-vis its extension spring.

It is entirely possible, with boxers punching rapidly, for all three extension springs to be reacting simultaneously.

Thus it is apparent that applicant's device provides a punch training mechanism for boxers requiring split-second decisions as to where to strike and when to strike, approximating more closely movements made by an opponent in a match.

If, however, one boxer utilizes the device, influence by the second boxer on the second punching bag is eliminated and device responds similarly as does available punching bags and the bag's movements may be anticipated for multiple rapid strikes.

It is an object of the subject invention to provide a punching device which responds to a single boxer's strike wherein the position and timing of the return of the punching device may be ascertained.

It is another object of the subject invention to provide a device which may be utilized by a pair of boxers wherein the actions of one boxer effect the target for the other boxer.

It is still another object of the subject invention to provide a two boxer punching device wherein response of the object being struck may not be predicted.

It is still another object of the subject invention to provide a device simulating a sparing match where possibility of injury is practically negated.

Other objects of the invention will in part be obvious and will in part appear hereinafter. The invention accordingly comprises the apparatus and method comprising construction, combination of elements, and arrangement of parts which are exemplified in the following detailed disclosure and the scope of the application which will be indicated in the claims.

BRIEF DESCRIPTION OF THE DRAWINGS

For further understanding of the nature and objects of the present invention, reference should be had to the following detailed description taken in connection with the accompanying drawings wherein.

In various views, like index numbers refer to like elements.

DETAILED DESCRIPTION OF THE PREFERRED

Figure 1:
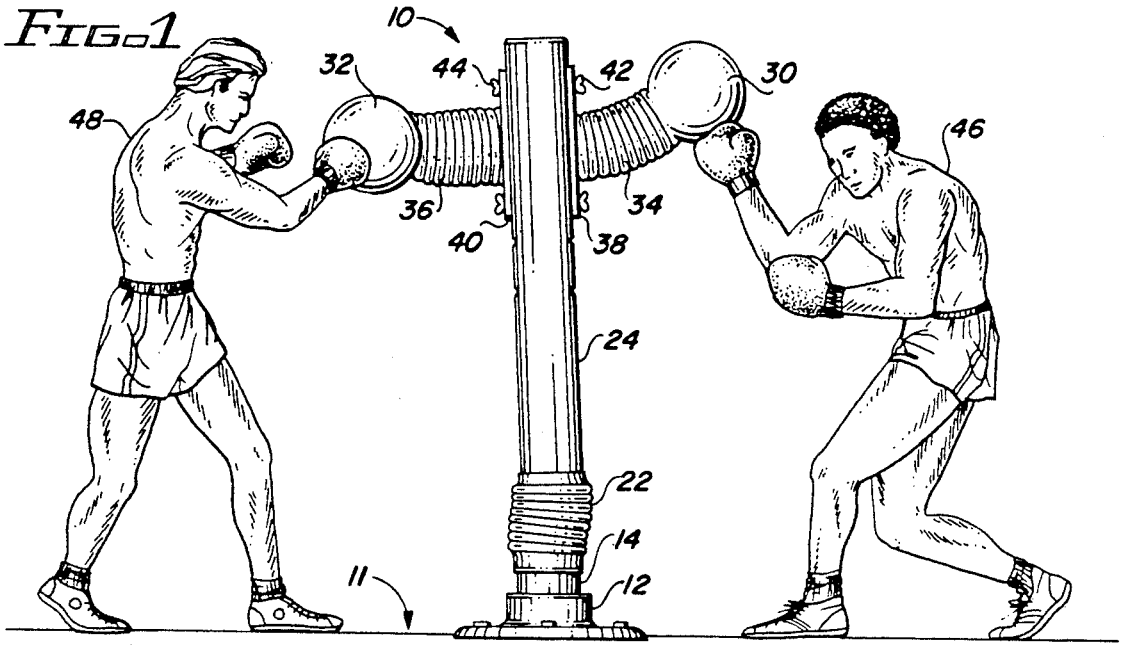
FIG. 1 is a front perspective view of the punching device for boxers being utilized by oppositely situated boxers.

Referring now to FIG. 1, a front perspective view of the inventive punching device for boxers is shown being utilized by two boxers simultaneously in order that in addition to the invention being affected by moves of one boxer, the opposite boxer utilizing the device will also have an effect upon the invention which will then effect the first boxer. More specifically, punching device 10 is shown with its base 12 fixedly attached to floor 11 by means of a plurality of bolts which penetrate the base flange to the flooring. In the preferred embodiment, base 12 was a metal threaded type flange adapted to receive lower post 14, which was threaded at one end, screwed into female threads contained in the upright portion of base 12. Lower post 14 is a rather short cylindrical post, extending up 6 to 8 inches, and capped with a round circular cap or disk. Welded to the round circular cap atop lower post 14 was an extension coil spring of the type wherein each coil of the spring touches the adjacent coil and the spring is characterized by the attributes that when it is perturbed it will flex, but always returns to its initial at rest position with little, if any at all, overshoot. The spring is situated atop the circular cap such that the cylindrical axis of the spring is pointed upward. Covering the spring in FIG. 1 is rubber boot 22. rubber boot 22 completely covering the enclosed spring and also covering a portion of lower post 14 and a portion of the next element in line, namely vertically orientated upright or upper post 24. The spring is attached to upper post 24 by first being welded to a square disk which caps the lower end of upper post 24, post 24 being square metal tubing in the preferred embodiment. In FIG. 1, a circular disk attached to lower post 14, the enclosed spring, and the square disk attached to upper post 24 and to the spring are not shown, all these elements being internal to rubber boot 22.

Upper post 14, operably attached to the coil spring internal to rubber boot 22, causes the punching device to respond to hits by the boxer. In FIG. 1, it can be seen that upper post 24 is responding to the right sided boxer and beginning to tip in the direction of the left sided boxer. In FIG. 1, the distortion in the spring is caused by upper post 24 beginning to respond. Upper post 24, in the preferred embodiment, is of a length of 4 to 5 feet and the total device stands about 6 feet high.

Attached near the top of upper post 24 are the portions of the invention which actually receive the blows from the boxer. These comprise 2 boxing bags, namely right sided boxing bag 30 and left sided boxing bag 32. Each of the boxing bags are operably connected to upper post 24 by means of separate extension coil springs situated internally to rubber boots 34 and 36, the internal extension coil springs attached to steel brackets 38 and 40, brackets 38 and 40 in turn attached to upper post 24 by means of threaded wing bolts 42 and 44 which screw into threaded height adjusting holes formed in upper post 24, thus securing the brackets to upper post 24 and thus the boxing bags 30 and 32.

In FIG. 1, the reaction of a boxing bag to a boxer can be seen, boxing bag 30 retreating upward from the upper cut of right side boxer 46 with the post 24 responding also. Now, for the left side boxer 48, boxing bag 32 will reflect the movement imparted into it by its connection to upper post 24 through its extension spring contained internally to rubber boot 36. Thus boxer 48 will return a punch to boxing bag 32 whose action is effected by boxer 46 punch to bag 30 as movement is modified by the 3 extension coil springs contained inside of the rubber boots 22, 34, and 36.

In turn, as the left hand side boxer 48 hits boxing bag 32, and changes what prior momentum and direction of movement it had, the new direction of momentum taken by boxing bag 32 will be reflected through the 3 extension coil springs to cause movement to the right hand boxing bag 30. Obviously, movement of one boxing bag relative to the other is not easily predictable so that both boxers, when using the device simultaneously, must always be on their toes as to the position of the boxing bags at any one time and thus simulate more closely the actual boxing conditions in a match but reducing substantially the chances of being hurt by a return blow from the opposite fighter.

Figure 2:
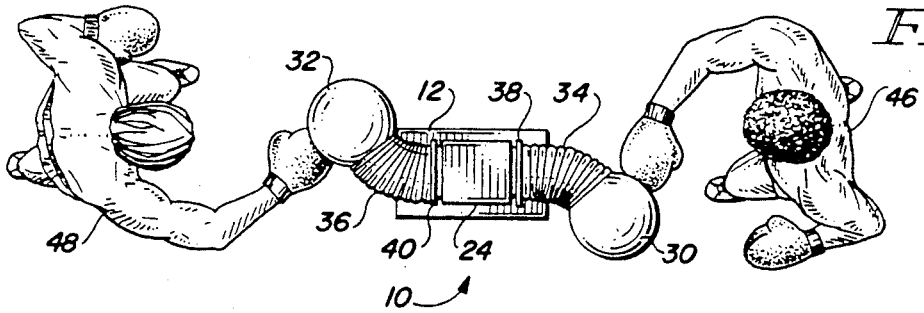
FIG. 2 is a top perspective view of the punching device for boxers being utilized by oppositely situated spaced apart boxers.

Referring now to FIG. 2, a top view of the inventive punching device for boxers is shown wherein both boxers are hitting each boxing bag simultaneously. In FIG. 2, the positions of the boxing bags relative to the centrally located upper post 24 is shown together with the brackets 38 and 40 connecting to post 24, boots 34 and 36 covering the extension springs internally thereto and finally the boxing bags 30 and 32.

Figure 3:
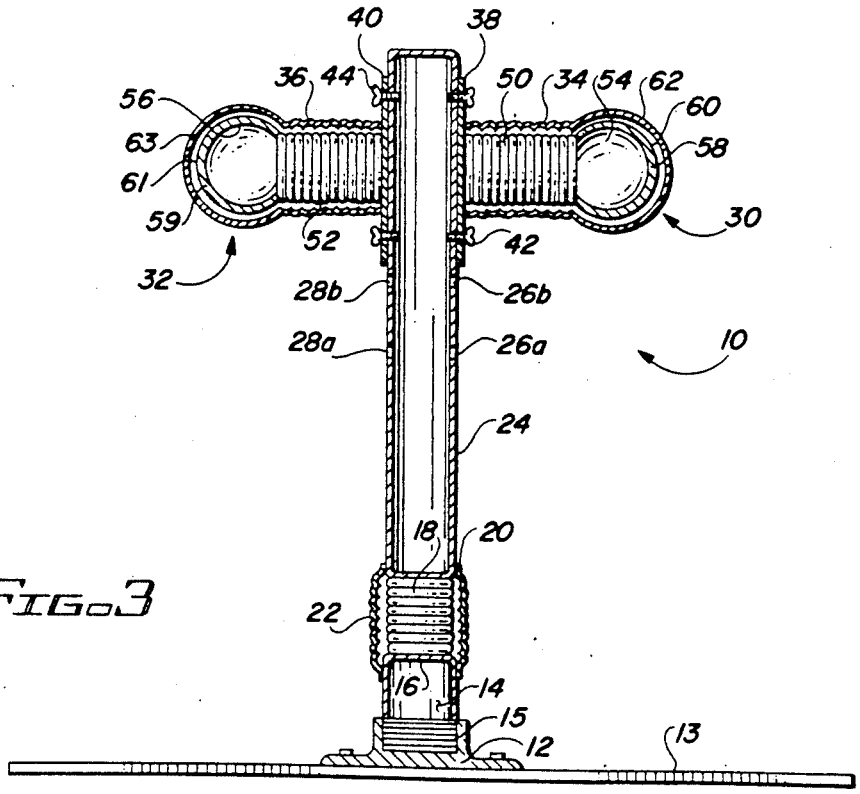
FIG. 3 is a side view of the invention in cross-section to illustrate the elements of the device comprising the invention.

FIG. 3 is a front view of the inventive punching device for boxers wherein a cross-sectional view of the device is taken to open up for viewing its internal parts. Beginning at the bottom, one change has been made from the embodiment shown in FIG. 1 inasmuch as base 12 has been attached to a portable base board 13 which allow the device to be picked up and moved as desired. Such a base board must be sufficiently sized that it will not exhibit a tendency to allow the device to tip over, and yet not interfere with the feet of the fighters as they step around. Attached to base 12 by its screwable threads is lower post 14, its threads being shown by numeral 15. Atop lower post 14 is circular disk 16, attached by welding, the other side of circular disk 16 attached to extension coil spring 18, preferably also by welding. surrounding extension coil 18 is rubber boot 22, exposed here to show the spring and the elements attached directly to it. Situated above extension coil spring 18 is square disk 20 attached to the bottom of square tubing upper post 24 by welding. Spring 18 is welded to the bottom side of square disk 20. All extension coil springs utilized in the invention were circular in shape.

Proceeding upward, the various threaded openings in upper post 24 are shown by the numerals 26*a* and 26*b* and 28*a* and 28*b*. The openings are so spaced that a relatively large number of height positions may be selected for mounting of the boxing bags. Shown in FIG. 3 near the top portion of upper post 24 are the mounting hardware for the boxing bag. Firstly, flat steel brackets 38 and 40 are shown in cross-section which have centrally located respective extension coil springs 50 and 52 attached thereto by welding. Brackets 38 and 40 are attached to upper post 24 by means of threaded wing bolts 42 and 44 which penetrate an opening in the brackets to threaded openings in upper post 24. In the preferred embodiment, each bracket had 2 threaded wing bolts, one above each extension coil spring and one below.

As mentioned above, on the right hand side is right side extension coil spring 50 attached to bracket 38 and on the left hand side, left side extension coil spring 52 attached to bracket 40. Covering both of these coil springs are right hand side rubber boot 34 and left hand side rubber boot 36 respectively. Making up the right sided boxing bag 30 is firstly a metal sphere 54, sphere 54 attached by welding or by other method to one end of right side extension coil spring 50. On the left hand side, metal sphere 56 is in turn attached to one end of left side extension coil spring 52, preferably by welding or by other method. Covering both metal spheres are 2 layers of padding, namely on sphere 54, first layer 58 and second layer 60. Both of these layers are removable in order that the total padding may be adjusted as desired. Lastly, covering the outside of right sided boxing bag 30 is a removable leather cover 62.

As on the right side, the left side metal sphere 56 is covered also by 2 layers of padding, namely first layer 59 and second layer 61. Both these layers, like their counterpart on the right hand side, are removable. Lastly, the left side metal sphere 56 is covered with a removable leather cover 63.

In addition, it is readily apparent that the invention has obviated one of the primary concerns of boxers, i.e., that of the boxers injuring themselves during sparing matches.

While the description above has centered upon the use of the invention by two boxers, it is readily appreciated that a single boxer may utilize the invention and when doing so, the invention, without the influence of the second boxer, will respond similarly to such that position of return of the punching bag may be predicted such as in the other types of punching bag device presently in common usage. Modification of the invention shown in FIG. 3 for use by a sole boxer may be easily accomplished by removal of the left sided punching bag 32 and the apparatus connecting it to upright post 24, namely spring 52 and its covering and attaching flange.

While a preferred and an alternate embodiment of the subject invention has been shown and described, it will be understood that there is no intent to limit the invention by such disclosure, rather it is intended to cover all modifications and alternate constructions falling within the spirit and the scope of the invention as defined in the appended claims.

I claim:

1. A punching device for utilization by two boxers simulating boxing and sparing matches comprising:

a first punching bag available to a first boxer to receive strikes;

a vertically oriented upright post operably attached to said first punching bag, said upright post suspending said first punching bag proximate the first boxer;

a second punching bag operably attached to said upright post and suspended proximate a second boxer, said second punching bag available to the second boxer to receive strikes;

a base adapted to be fixedly attached to a ground surface; and, an upright extension spring having two ends, one end of which is fixedly attached to said base and the other end of which is fixedly attached to said upright post, said upright extension spring characterized such that when said other end is perturbed, said other end returns to its original position without overshoot whereby the first boxer may strike said first punching bag and thereby influence the position and movement of said second punching bag through said commonly connected upright post and thus present said second punching bag as a moving target to the second punching bag as a moving target to the second boxer who in turn, in striking said second punching bag, influences the position and movement of said first punching bag for strikes by the first boxer.

2. The punching device for boxers as defined in claim 1 further including a first spring interposed said punching bag and said upright post, said first spring having two ends, the first end of which is fixedly attached to said punching bag and the second end of which is operably attached to said upright post.

3. The punching device for boxers as defined in claim 2 wherein said first spring interposed said punching bag and said upright post comprises a first extension spring adapted to return said first punching bag to its original position without overshoot after said first punching bag has been struck by the first boxer.

4. The punching device for boxers as defined in claim 3 further including a second spring interposed said second punching bag and said upright post, said second spring having two ends, the first end of which is fixedly attached to said punching bag and the second end of which is operably attached to said upright post.

5. The punching device for boxers as defined in claim 4 wherein said second spring interposed said punching bag and said upright post comprises a second extension spring adapted to return said second punching bag to its original position without overshoot after said second punching bag has been struck by the second boxer.

6. The punching device for boxers as defined in claim 5 further including a first bracket, said first bracket fixedly attached to said first extension spring second end, said bracket operably attached to said upright post.

7. The punching device for boxers as defined in claim 6 further including a second bracket, said second bracket fixedly attached to said second extension spring second end, said bracket operably attached to said upright post.

8. The punching device for boxers as defined in claim 7 wherein said first and said second brackets are movably attached to said upright post whereby the height of each bracket on said upright post may be adjusted as desired to accommodate the boxers.

9. The punching device for boxers as defined in claim 8 wherein said upright post has at least two opposite sides and said first bracket is attached to one side and said second bracket is attached to said opposite side, said first and said second punching bags situated on opposite sides of said upright post.

10. The punching device for boxers as defined in claim 9 further including a plurality of rubber boots, one of said plurality of rubber boots adapted to encompass each said upright extension spring, said first extension spring, and said second extension spring whereby all said extension springs are covered in order to provide a padding in case of accidental strike by the boxers.

11. A punching device for boxers to be used by a single boxer providing practice for punches and response to punches, said punching device comprising:

a punching bag available to a boxer to receive strikes;

a vertically oriented upright post operably attached to said punching bag, said upright post suspending said punching bag proximate the boxer;

a first spring interposed said punching bag and said upright post, said spring having two ends, the first end of which is fixedly attached to said punching bag and the other end of which is operably attached to said upright post;

a base adapted to be fixedly attached to a ground surface, said base operably attached to said upright post; and an upright extension spring having two ends, one end of which is fixedly attached to said base and the other end of which is fixedly attached to said upright post, said upright extension spring characterized such that when said other end is perturbed, said other end returns to its original position without overshoot whereby the boxer may strike the punching bag causing it to respond away from the boxer's strike in accordance with the influence of said upright spring and said first spring and then return the punching bag to its position prior to being struck.

12. The punching device as defined in claim 10 wherein said first spring interposed said punching bag and said upright post comprises a first extension spring adapted to return said punching bag to its original position without overshoot after said punching bag has been struck by the boxer.

13. The punching device as defined in claim 12 further including a bracket, said bracket fixedly attached to said first extension spring second end, said bracket operably attached to said upright post.

14. The punching device for boxers as defined in claim 13 wherein said bracket is movably attached to said upright post whereby the height of said bracket on said upright post may be adjusted as desired to accommodate the boxer.

15. The punching device for boxers as defined in claim 14 further including a pair of rubber boots, one of said pair of rubber boots adapted to encompass said upright extension spring and the other of said pair of rubber boots adapted to encompass said first extension spring whereby all said extension springs are covered in order to provide a padding in case of accidental strike by the boxer.

* * * * *